United States Patent [19]

Ko

[11] Patent Number: 5,008,867

[45] Date of Patent: Apr. 16, 1991

[54] ORNAMENTAL CLOCK WITH DECORATIVE TIME INDICATING DEVICE

[76] Inventor: Wei C. Ko, No. 36, Alley 53, Lane 514, Chung Cheng Rd., Hsin Chuang City, Taipei Hsien, Taiwan

[21] Appl. No.: 555,604

[22] Filed: Jul. 23, 1990

[51] Int. Cl.[5] ..... G04B 19/22

[52] U.S. Cl. ..... 368/23; 368/223

[58] Field of Search ..... 368/21-24, 368/76, 80, 88, 223-234, 322-323

[56] References Cited

U.S. PATENT DOCUMENTS

| | | | |
|---|---|---|---|
| 1,079,796 | 11/1913 | Nordling | 368/23 |
| 1,959,601 | 5/1934 | Schulse | 368/24 |
| 3,184,909 | 5/1965 | Lohf et al. | 368/220 |
| 3,348,321 | 10/1967 | Cunningham | 368/24 |
| 3,527,046 | 9/1970 | Pawl | 368/24 |
| 3,684,263 | 8/1987 | Etienne | 368/322 |
| 3,823,548 | 7/1974 | Riba | 368/21 |

FOREIGN PATENT DOCUMENTS

| | | | |
|---|---|---|---|
| 86/01916 | 3/1986 | PCT Int'l Appl. | 368/23 |

*Primary Examiner*—Vit W. Miska

*Attorney, Agent, or Firm*—Lalos & Keegan

[57] ABSTRACT

An ornamental clock with decorative time indicator, wherein the hour, minute and second indicator rotating shafts are elongated and can steadily rotate without swinging, characterized in that the elongated rotating shafts can accurately and co-axially and point-to-point rotatably contact with one another so that friction therebetween can be reduced to a minimum and they can be steadily driven by their corresponding indicator connectors without swinging movement, the second indicator being of global shape and the minute and hour indicator being two transparent or perforated spheres whereby when they relatively rotate at different speeds, the time is accurately indicated and excellent decorative effect is created.

4 Claims, 6 Drawing Sheets

ORNAMENTAL CLOCK WITH DECORATIVE TIME INDICATING DEVICE

BACKGROUND OF THE INVENTION

The present invention relates to an ornamental clock with decorative time indicating device, and more particularly to an ornamental clock in which rotating shafts for indicating the hour, minute and second are elongated and connected with decorative time indicating device.

Conventional clock applies gears to drive the hour, minute and second connectors which associate with hour, minute and second indicators for indicating time. Because the length of the hour, minute and second connectors is limited so that the time indicators can not be freely modified and thus the conventional design is unable to satisfy the present consumers who like new things. An improved clock with decorative and varied time indicators is developed to change the traditional time indicating way. However, such clock requires longer time indicator rotating shafts to connect with original hour, minute and second rotating shafts, and the longer time indicator rotating shafts are apt to rotate unstably and swing and to clause a lot of friction therebetween due to poor connection design and therefore it is difficult to perform an accurate time indication and the quality of such clock is unreliable.

SUMMARY OF THE INVENTION

It is therefore a primary object of this invention to provide an ornamental clock with decorative time indicator in which the elongated rotating shafts are tightly fitted with original corresponding time indicator connectors for driving the decorative time indicators. Moreover, the elongated rotating shafts are co-axially accurately rotatably associated with one another so that the elongated rotating shafts can steadily rotate without swinging.

DETAILED DESCRIPTION OF THE PREFERRED EMBODIMENT

Figure 1A:
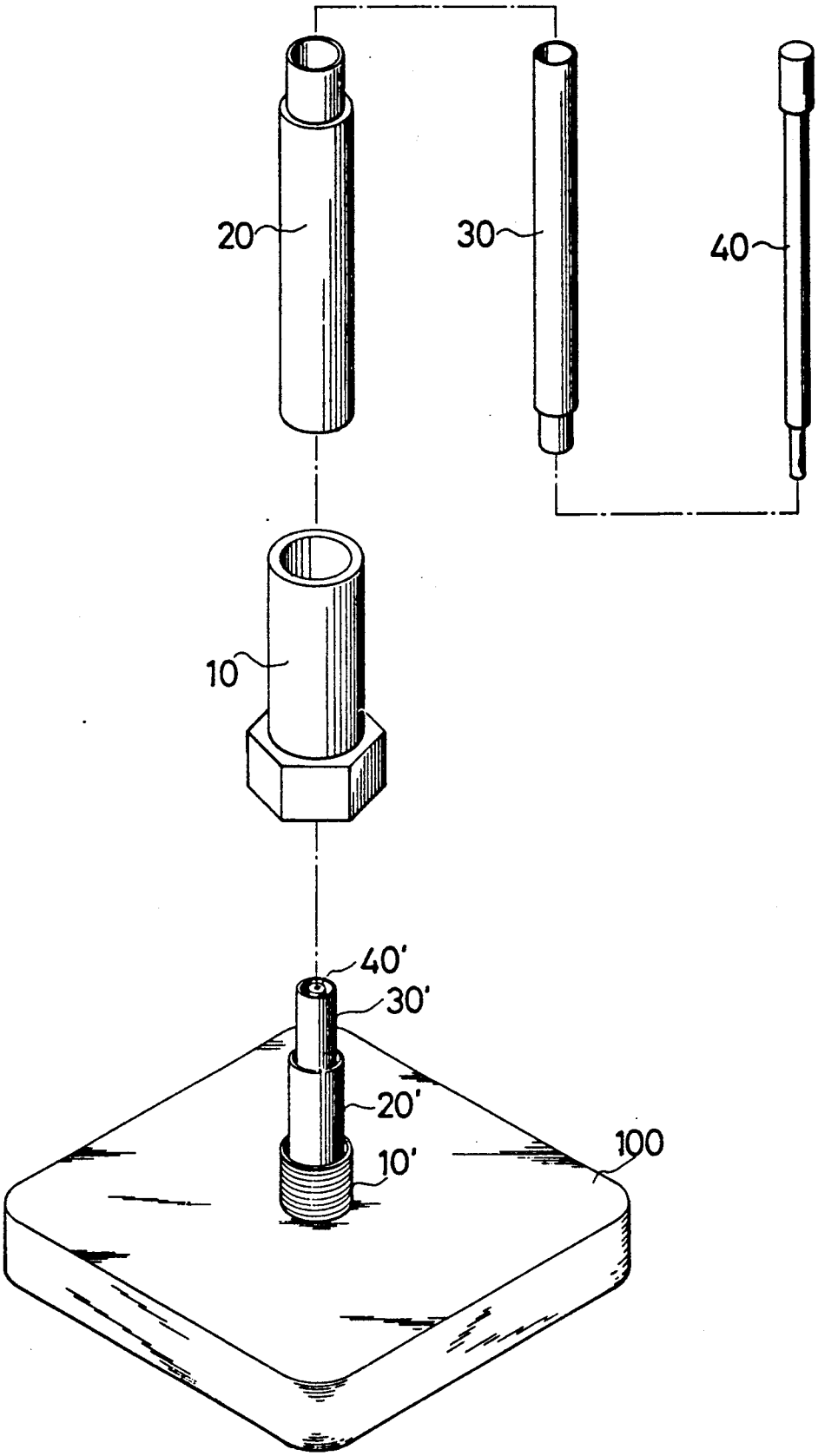
FIG. 1A is an exploded perspective view of one embodiment of the elongated rotating shaft of this invention.

Please first refer to FIGS. 1 and 2. The present invention includes a clock base 100, thread sleeve 10, 10A, 10B hour indicator rotating shaft 20, 20A minute indicator rotating shaft 30, and second indicator rotating shaft 40, wherein the thread sleeve 10 is formed with a lower inner thread hole 11, 11A, 11B and an upper small diameter through hole 12. The base 100 is provided with a connector 10' having outer thread on which the inner thread hole 11 of thread sleeve 10 is screwed. The outer surface 21 of lower end of the hour indicator rotating shaft 20 is closely rotatably fitted in the top through hole 12 of the thread sleeve 10 while inner surface 22, 22A of lower end of the rotating shaft 20 is tightly fitted to the outer surface of the hour indicator connector 20' with a substantial length so as to prevent swinging movement during operation. The outer surface 23 of upper end of the hour indicator rotating shaft 20 can be connected with a decorative hour indicator 2 (see FIGS. 5 and 6). Similarly, the outer surface 31 of lower end of the minute indicator rotating shaft 30, 30A is closely rotatably connected with inner surface 24 of upper end of the hour indicator rotating shaft 20 while inner surface 32 of lower end of rotating shaft 30 is tightly fitted to the outer surface of the minute indicator connector 30' with a substantial length so as to prevent swinging movement during operation. The outer surface 33 of upper end of the minute indicator rotating shaft 30 can be associated with a decorative minute indicator 3. Still similarly, outer surface 41 of lower end of the second indicator rotating shaft 40, 40A is closely rotatably connected with inner surface 34 of upper end of the minute indicator rotating shaft 30 while inner surface 42 of lower end of the second indicator rotating shaft 40 is tightly fitted to a second indicator connector 40' with a substantial length so as to prevent swinging movement during operation. The outer surface 43, 43A of upper end of the second indicator rotating shaft 40 can be connected with a decorative second indicator 4.

According to the above arrangement, the elongated rotating shafts can steadily rotate following their respective corresponding time indicator connectors, and by means of the accurate point to point rotatable contact between the elongated time indicator rotating shafts to reduce the friction therebetween to a minimum, the drawback of swinging of prior art can be completely eliminated and the time can be accurately indicated.

Another embodiment of rotating shaft of this invention is shown in FIG. 3, wherein outer surfaces of the elongated rotating shafts 20A, 30A, 40A are respectively formed with annular projections 21A, 31A, 41A whereby the inner surfaces 12A, 24A, 34A of the thread sleeve 10A and rotating shafts 20A, 30A can accurately rotatably contact in a form of point-to-point with the annular projections 21A, 31A, 41A permitting the elongated rotating shafts 20A, 30A, 40A to rotate steadily without swinging, and the time can also be accurately indicated.

Figure 4:
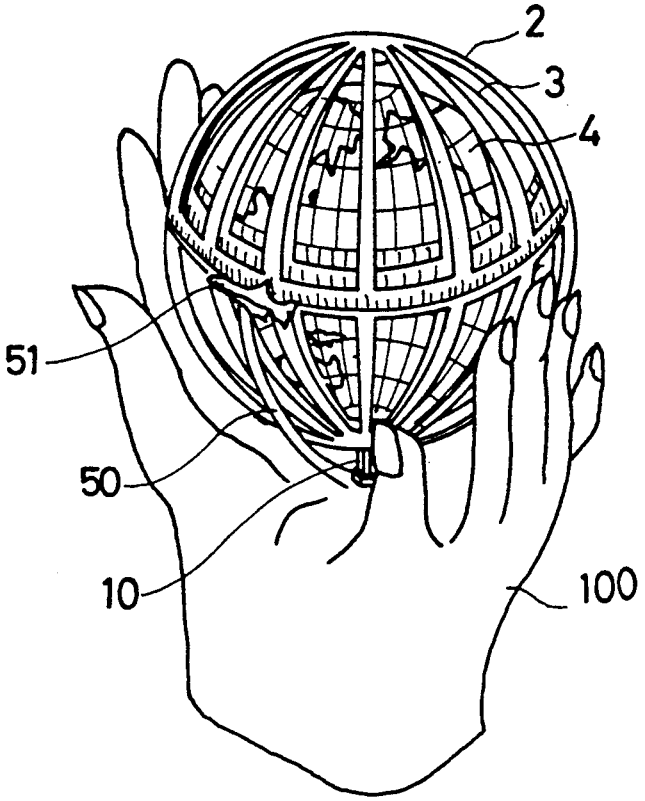
FIG. 4 is a perspective view of one embodiment of the clock base and decorative hour, minute and second indicators which are of spherical shape.
Figure 5:
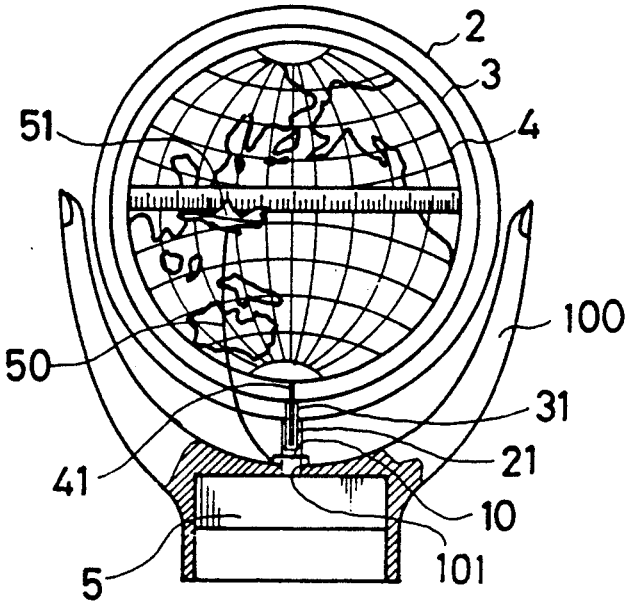
FIG. 5 is a sectional view according to FIG. 4.
Figure 6:
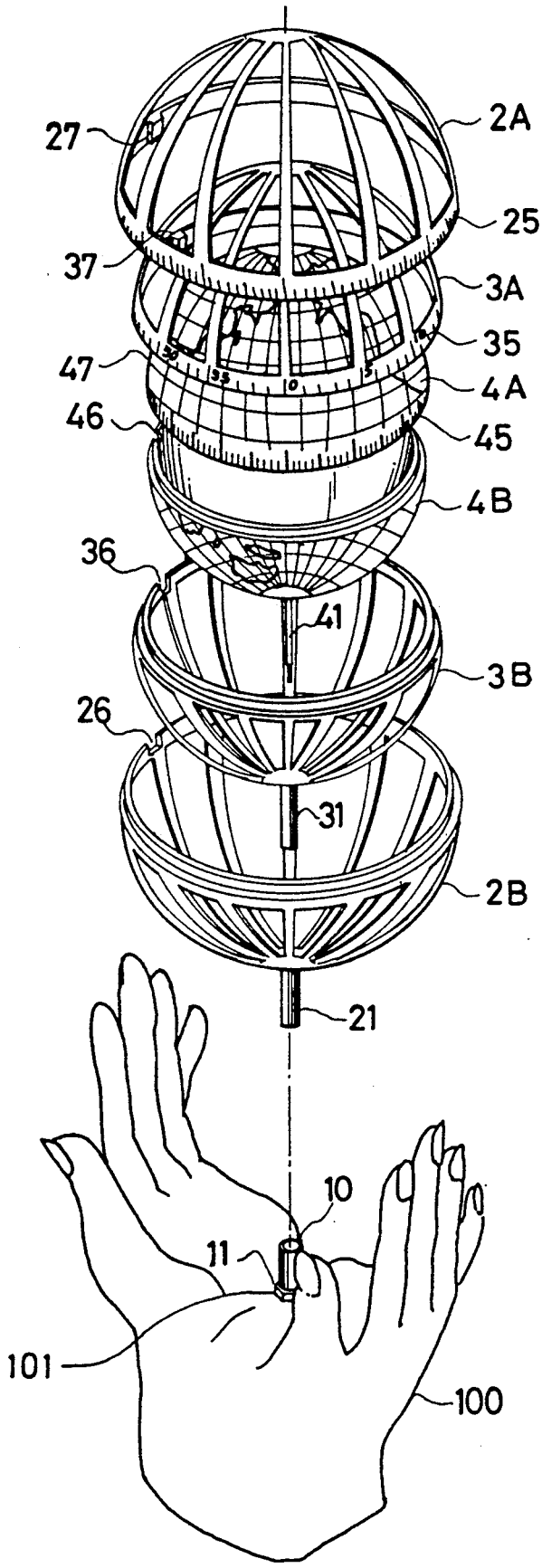
FIG. 6 is an exploded perspective view according to FIG. 4.

Please now refer to FIGS. 4, 5, and 6, in which one embodiment of the clock base 100 with a co-axial globe decorative time indicators 2, 3, 4, are shown. In this embodiment, the clock base 100 is of the shape of two hands facing upward. The clock base 100 is hollow to receive a clock mechanism 5 including second indicator connector 40', minute indicator connector 30', and hour indicator connector 20' which extend outward through an upper central hole 101 of the clock base 100. The second indicator 4 is of globe shape formed with two halves thereof in this embodiment. However, it also can be of other suitable shapes. A second scale 45 is disposed around the central portion of outer surface of the second indicator 4 which is engaged with the upper end 43 of the elongated rotating shaft 40, the lower end of which is further fixed to the second indicator connector 40' so that the second indicator 4 of globe shape can be rotarily driven by the clock mechanism 5 and by means of the second scale 45 and an index 51 of airplane shape, the seconds can be thus accurately calculated.

The minute indicator 3 is transparent or perforated configuration and formed by two semispheres. Similarly, a minute scale 35 is disposed around the central portion of outer surface of the minute indicator 3 and by means of the elongated rotating shaft 30, the minute indicator 3 is connected with the minute indicator connector 30' so as to be driven thereby for calculating minutes.

The hour indicator 2 is also transparent or perforated configuration and formed by two semispheres, and a hour scale 25 is disposed therearound. The elongated rotating shaft 20 connects the hour indicator 2 with the hour indicator connector 20' so as to be driven thereby for calculating hours.

Two semispheres of the second, minute and hour global indicators 4A, 4B, 3A, 3B, 2A, 2B are respectively connected together by their respective tenon members 47, 37, 27 and mortise members 46, 36, 26 and spaces are kept between these three spherical indicators due to their diameter difference.

Figure 1B:
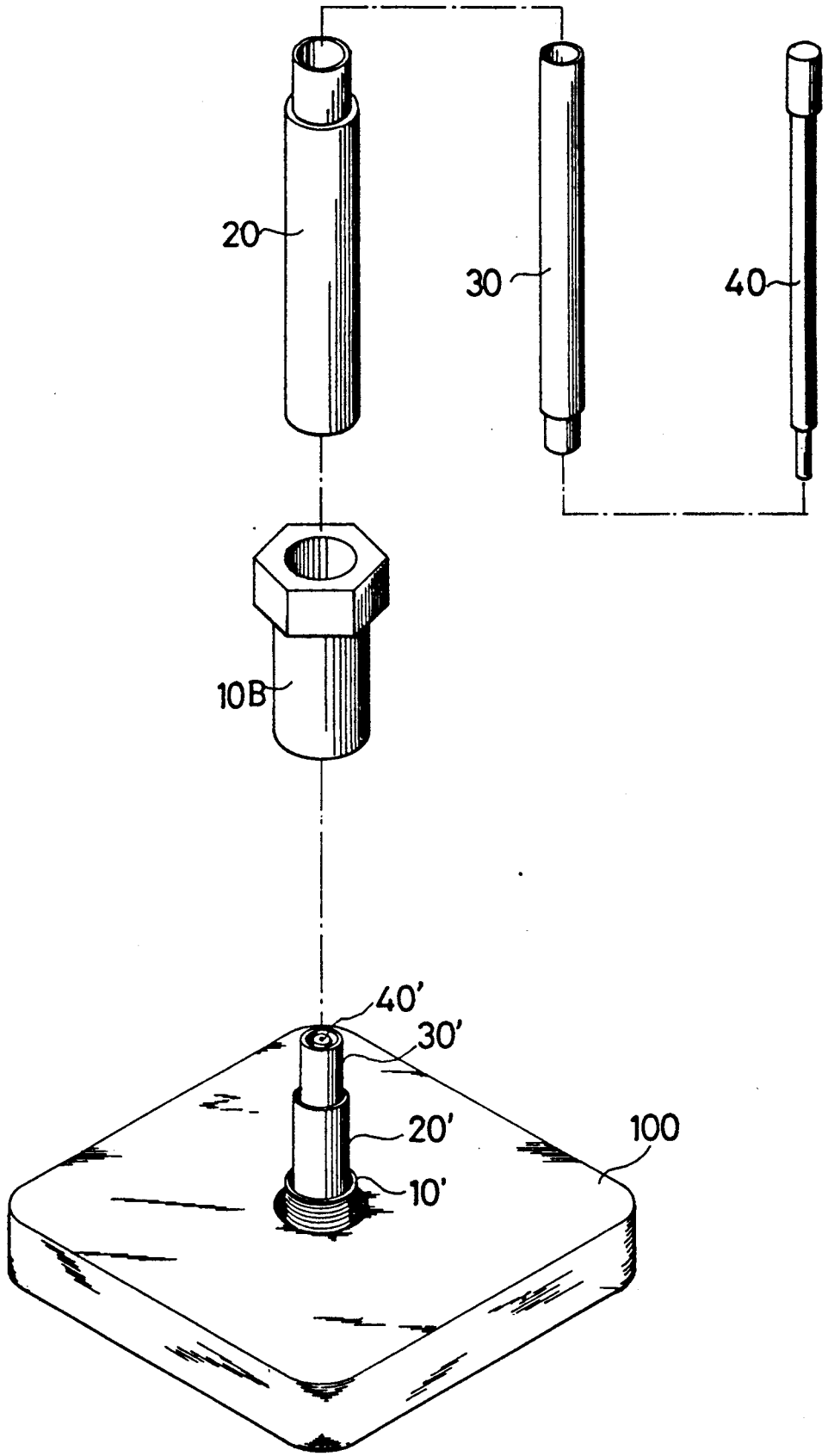
FIG. 1B is another embodiment of FIG. 1A.
Figures 2A, 2B:
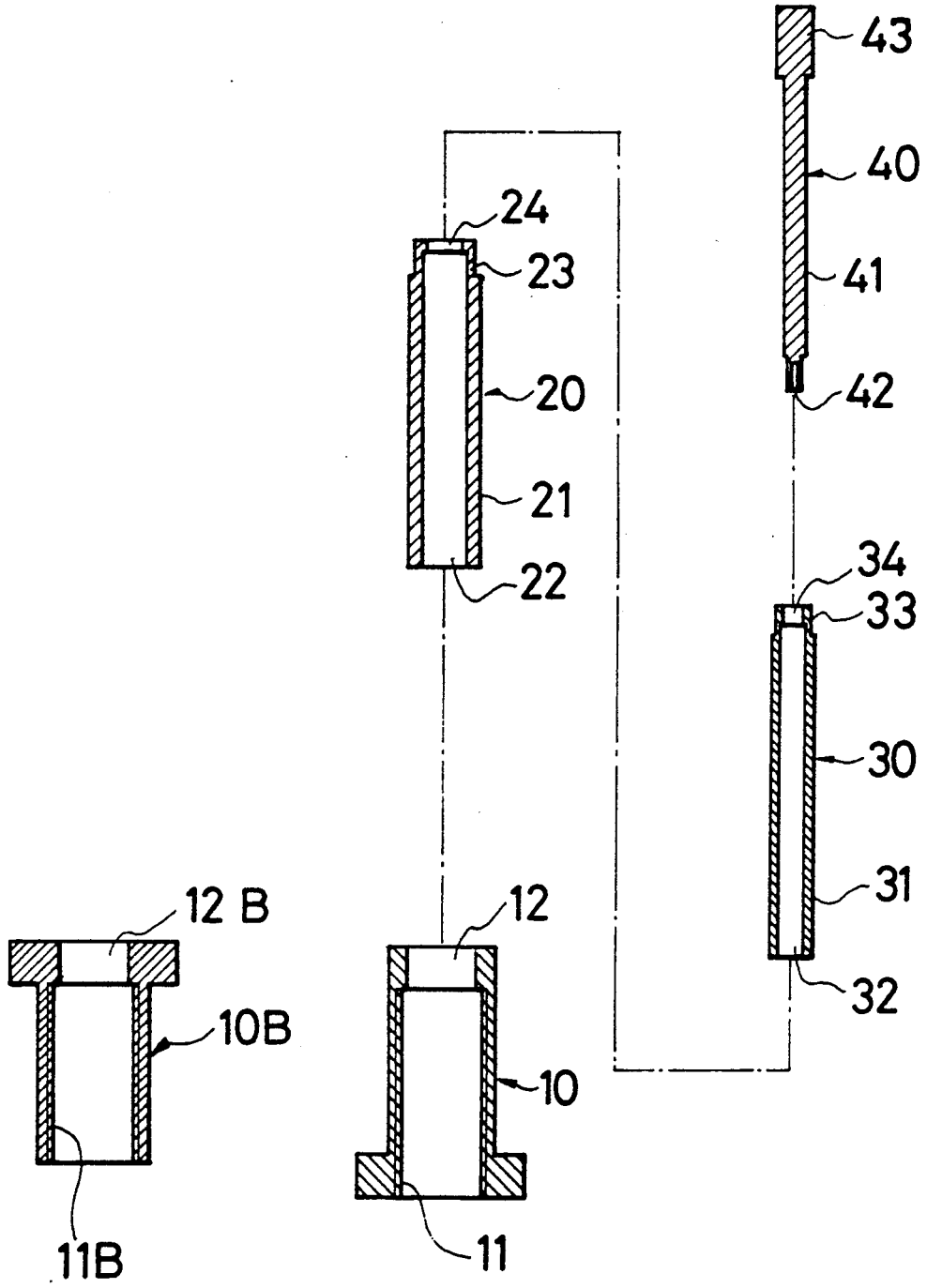
FIGS. 2A and 2B are sectional view according to FIG. 1A and 1B respectively.
Figure 3B:
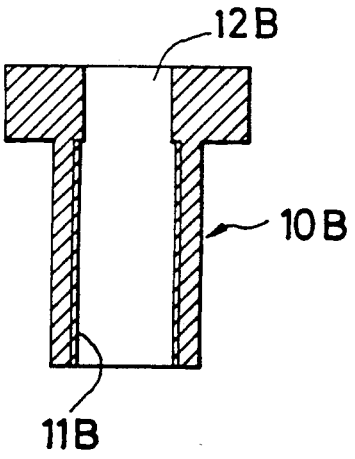
FIGS. 3A and 3B are a sectional view of another embodiment of the elongated rotating shaft of this invention.
Figure 3A:
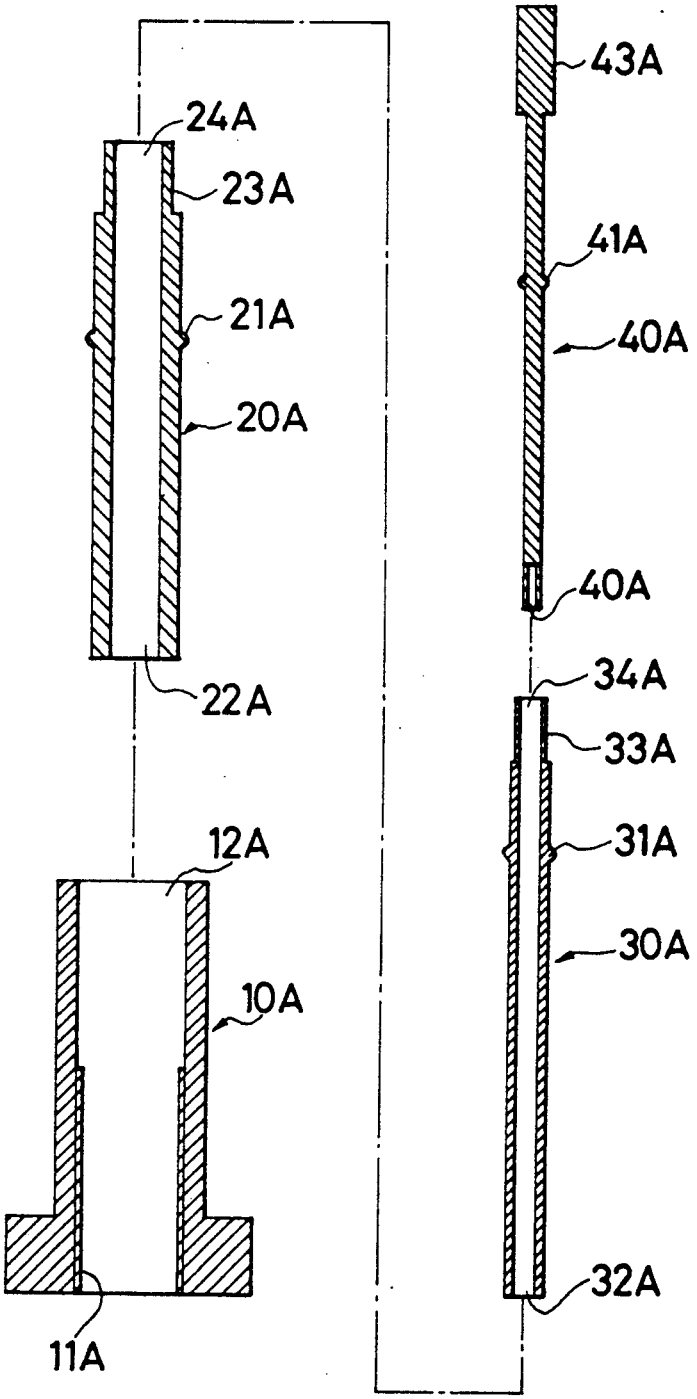

It is to be understood that the thread sleeves 10, 10A as shown in FIGS. 1A, 2A and 3A can also be disposed in reverse direction as shown in FIGS. 1B, 2B and 3B wherein the nut members are changed to the upper portion instead of the lower portion thereof so as to enable the thread sleeve still to be screwed on the outer thread of the connector 10' of the base when the thread portion of connector 10' is disposed below the upper surface of the base or the top end of the connector 10' is under the surface of the base. It is also to be understood that the embodiment of the decorative time indicators mentioned above is of a global or spherical configuration, however, any other suitable shape or construction decorative time indicator may also be applicable to attain an identical ornamental purpose of clock of the present invention.

According to the above arrangement, the global time indicators 2, 3, 4 can relatively rotate at different speeds to indicate the proper time without swinging movement.

I claim:

1. An ornamental clock with decorative time indicating device comprising:

a clock machanism 5;

a clock base 100 for receiving said clock machanism 5 having a connector 10' formed with outer thread extending upward from the clock base 100;

an original hour, minute and second indicating connectors 20', 30', 40' being co-axially provided within said connector 10' and extending upward thereform with their respective height;

a thread sleeve member 10, 10A, 10B formed with a lower inner thread hole 11, 11A, 11B and an upper small diameter through hole 12, 12A, 12B, said inner thread hole 11, 11A, 11B being screwed on said outer thread of said connector 10' of said clock base 100;

a decorative hour indicator 2;

an hour indicator rotating shaft 20, 20A, inner surface 22, 22A of lower end of which is tightly fitted to the upper end of said original hour indicating connector 20', and outer surface of upper end 23 of which is associated with said decorative hour indicator 2;

a decorative minute indicator 3;

a minute indicator rotating shaft 30, 30A, outer surface of lower end 31 of which closely rotatably contacts with inner surface 24 of upper end of said hour indicating rotating shaft 20, 20A, and inner surface of lower end 32 of which is tightly fitted to said original minute indicator connector 30', and the outer surface 33 of upper end of which is associated with said decorative minute indicator 3;

a decorative second indicator 4; and a second indicator rotating shaft 40, 40A, outer surface of lower end 41 of which closely rotatably contacts with inner surface 34 of upper end of said minute indicator rotating shaft 30, 30A, and inner surface of lower end 42 of which is tightly fitted to said original second indicator connector 40', and outer surface 43, 43A of upper end of which is associated with said decorative second indicator 4.

2. An ornamental clock as claimed in claim 1, wherein each said indicator rotating shaft 20A, 30A, 40A is formed with an annular projection 21A, 31A, 41A on their outer surface whereby said annular projections 21A, 31A, 41A can closely accurately rotatably contact inner surfaces of said thread sleeve 10A and hour indicator rotating shaft 20A, and minute indicator rotating shaft 30A respectively, to prevent swinging movement.

3. An ornamental clock as claimed in claim 1, wherein said clock base 100 is of a shape of two hands facing upward, and is hollow to receive a clock mechanism 5, and said hour, minute and second indicator connectors 20, 20A, 30, 30A, 40, 40A extend upward through an upper central hole 101 of said clock base, and wherein said decorative second indicator 4 is of earth shape and is surrounded by a second scale 45 on the central portion thereof, and said decorative minute indicator 3 is a transparent sphere surrounded by a minute scale 35 on the central portion thereof, and said decorative hour indicator 2 is also a transparent sphere surrounded by an hour scale 25 on the central portion thereof, and an index 51 is provided on said clock base to indicate the time, spaces being kept between said three decorative time indicators 2, 3, 4 which relatively rotate at different speeds to show the time.

4. An ornamental clock as claimed in claim 3, wherein said three spherical decorative time indicators 2, 3, 4 are associated by tenon members 27, 37, 47 and mortise members 26, 36, 46.

* * * * *